US011744297B1

(12) United States Patent
Coggiola-Belza

(10) Patent No.: US 11,744,297 B1
(45) Date of Patent: Sep. 5, 2023

(54) NURSING GARMENT WITH INTEGRATED REMOVABLE PADS

(71) Applicant: Leigh Coggiola-Belza, Plano, TX (US)

(72) Inventor: Leigh Coggiola-Belza, Plano, TX (US)

( * ) Notice: Subject to any disclaimer, the term of this patent is extended or adjusted under 35 U.S.C. 154(b) by 126 days.

(21) Appl. No.: 17/333,939

(22) Filed: May 28, 2021

(51) Int. Cl.

| | |
|---|---|
| ***A41C 3/04*** | (2006.01) |
| ***A41F 1/00*** | (2006.01) |
| ***A41B 9/06*** | (2006.01) |
| ***A41D 1/215*** | (2018.01) |

(52) U.S. Cl.
CPC ..... *A41C 3/04* (2013.01); *A41B 9/06* (2013.01); *A41D 1/215* (2018.01); *A41F 1/006* (2013.01)

(58) Field of Classification Search
CPC ..... A41B 9/06; A41C 3/04; A41F 1/006
See application file for complete search history.

(56) References Cited

U.S. PATENT DOCUMENTS

| | | | | | |
|---|---|---|---|---|---|
| 1,984,253 | A * | 12/1934 | Cox | A41C 3/04 | 450/37 |
| 2,748,771 | A * | 6/1956 | Richards | A41C 3/04 | 450/36 |
| 3,478,739 | A | 11/1969 | Librande | | |
| 3,619,819 | A * | 11/1971 | Mann | A61F 2/52 | 623/7 |
| 4,338,946 | A * | 7/1982 | Donnelly | A41C 3/148 | 450/59 |
| 6,179,687 | B1 | 1/2001 | Lee et al. | | |
| 6,247,996 | B1 * | 6/2001 | Fields | A41C 3/04 | 450/36 |
| 6,319,092 | B1 * | 11/2001 | Leyhe | A41C 3/0071 | 450/36 |
| 7,448,090 | B2 | 11/2008 | Lucock | | |
| 8,257,140 | B2 * | 9/2012 | Kenny | A41C 3/0035 | 450/36 |
| 8,357,024 | B2 * | 1/2013 | Baker-Jackson | A61F 13/141 | 450/18 |
| 8,371,901 | B2 | 2/2013 | Frey | | |
| D702,936 | S * | 4/2014 | Burkett | D3/226 | |
| 9,307,793 | B2 * | 4/2016 | Kenny | A41C 3/0035 | |
| 10,231,491 | B2 | 3/2019 | Akerson et al. | | |
| 2004/0038621 | A1 | 2/2004 | Vera | | |
| 2005/0112996 | A1 | 5/2005 | Buehler | | |

(Continued)

FOREIGN PATENT DOCUMENTS

| | | | |
|---|---|---|---|
| JP | 2009068141 | A | 4/2009 |

*Primary Examiner* — Gloria M Hale
(74) *Attorney, Agent, or Firm* — Law Office of Sam Sokhansanj PLLC

(57) ABSTRACT

A nursing garment system having a body with a front and rear region, wherein the front region of the body includes a first securement member. The nursing garment further includes a first strap having a first and second end affixed to the body, and a second securement member disposed between the first and second end of the first strap. The nursing garment can also include a second strap having a first end secured to the front region of the body, a third securement member secured to the second end of the second strap, and a breast pad having a fourth securement member. Here, the third securement member of the second strap can be secured to the fourth securement member of the breast pad, and the second securement member of the first strap can be secured to the first securement member of the body.

7 Claims, 9 Drawing Sheets

(56) References Cited

U.S. PATENT DOCUMENTS

| | | | | |
|---|---|---|---|---|
| 2009/0286452 | A1* | 11/2009 | Grayson | A41C 3/04<br>128/890 |
| 2011/0065359 | A1* | 3/2011 | Kenny | A41C 3/12<br>450/39 |
| 2014/0342636 | A1 | 11/2014 | Johnson | |

* cited by examiner

NURSING GARMENT WITH INTEGRATED REMOVABLE PADS

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

One of the most stressful challenges facing new mothers is breast feeding their baby. These challenges can be from learning how to properly latch the baby on to the nipple to feed as well as keeping milk supply high enough to fully satiate the baby. Many new mothers are reluctant to go out in public for fear their baby will need to be fed and that they will not be able to do this in comfort and hygienically. In particular, many new mothers need to address the problems associated with leaking breasts postpartum. Breasts that can leak, drip, or spray milk in the weeks or months after delivery can be embarrassing, messy, and uncomfortable. There are a number of conventional nursing garments currently on the market. However, many of these garments do not specifically address the issue of leaking breasts. For example, such garments do not have dedicated pads or bras that can specifically and effectively absorb the milk fluid. Further, in some conventional solutions, large towels or small sheets are used to absorb the leaking milk fluid, which are bulky and typically made of heavy, non-breathable material. In other instances, nursing mothers would wear robes or t-shirts all day knowing (or not knowing) they will get these items of clothing soaked in breast milk, and thus, would need to stay indoors from embarrassment as their clothing is stained in milk blotches everywhere. Hence, many of these conventional garments and solutions are burdensome, inconvenient, and fail to address the longstanding and common problems associated with leaking breasts postpartum.

Hence, what is needed is a nursing garment that allows for simple operation of exposing a breast for breastfeeding purposes and further includes pads that are configured for effectively absorbing milk from leaking breasts, that are easily removable, washable, simple to manufacture, and comfortable to wear all day long.

BRIEF SUMMARY

A nursing garment is disclosed that allows for simple operation of exposing a breast for breastfeeding purposes and further includes pads that are configured for effectively absorbing milk from leaking breasts and are easily removable, washable, simple to manufacture, and comfortable to wear all day long. In one aspect of the disclosure described herein, a nursing garment having integrated removable pads is disclosed that allows for simple operation of exposing a breast for breastfeeding purposes and for effectively absorbing milk from leaking breasts, wherein the removable pads washable, simple to manufacture, and comfortable to wear all day long. In particular, the nursing garment can include a body with a front and rear region, wherein the front region of the body includes a first securement member. The nursing garment further includes a first strap having a first and second end affixed to the body, and a second securement member disposed between the first and second end of the first strap. The nursing garment can also include a second strap having a first end secured to the front region of the body, a third securement member secured to the second end of the second strap, and a breast pad having a fourth securement member. Here, third securement member of the second strap can be secured to the fourth securement member of the breast pad, and the second securement member of the first strap can be secured to the first securement member of the body.

In addition, the fourth securement member of the breast pad can indude a looped opening. Further, the first, second, and third securement members can include at least one of: a clip, carabiner, ring, hook, snap, adhesive, hook and loop fastener, or pin. Here, the breast pad can include a liquid absorbing first layer and second layer, wherein, wherein the first layer can be comprised of a velour fabric further including about 67% bamboo viscose, about 28% cotton, and about 5% polyester. In addition, the second layer can include about 85% cotton and about 15% polyester.

The above summary is not intended to describe each and every disclosed embodiment or every implementation of the disclosure. The Description that follows more particularly exemplifies the various illustrative embodiments.

BRIEF DESCRIPTION OF THE DRAWINGS AND PHOTOGRAPHS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
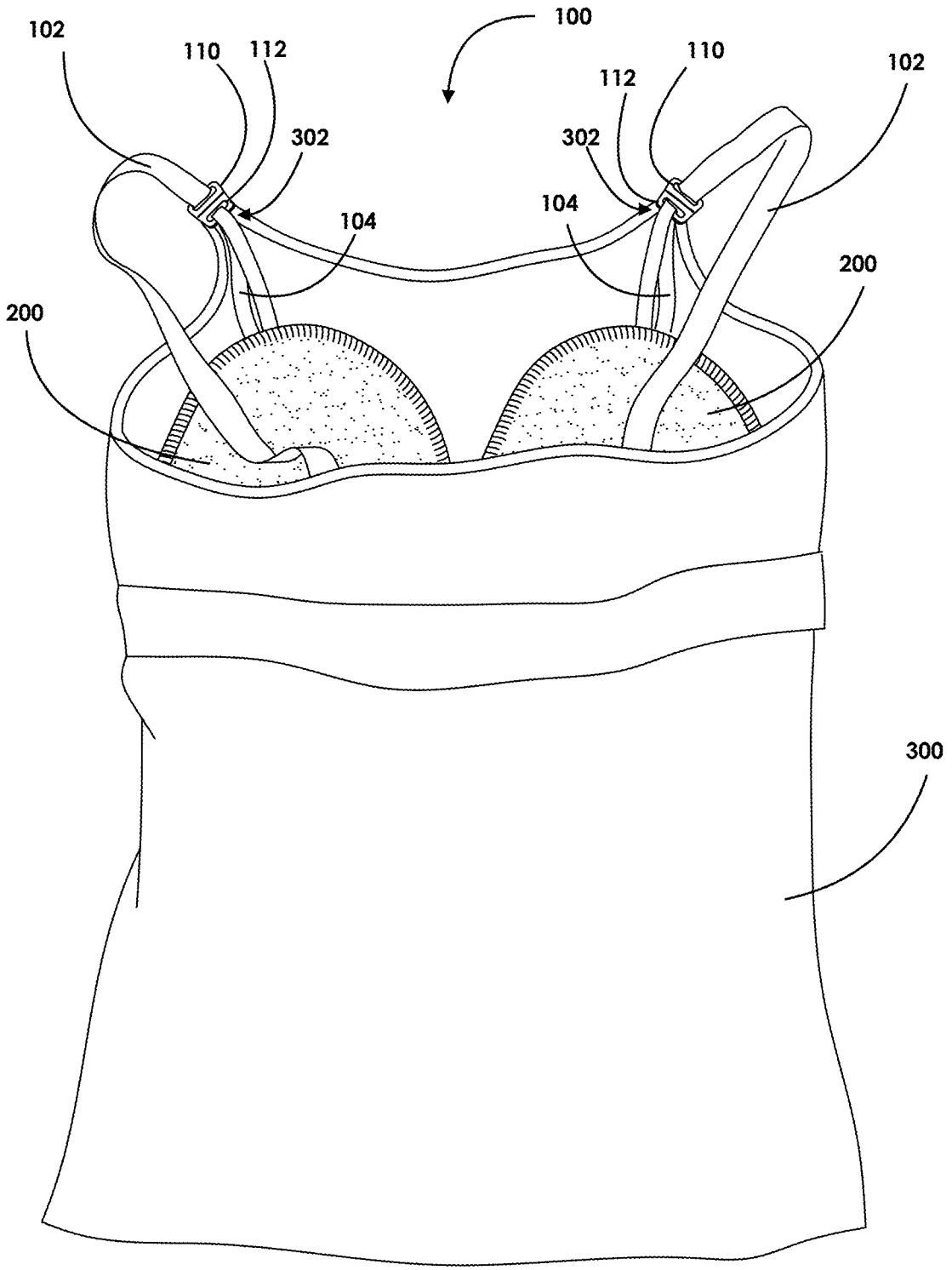
FIG. 1 illustrates a rear view of a nursing garment and its removable pads according to one non-limiting exemplary embodiment of the disclosure described herein.
Figure 2:
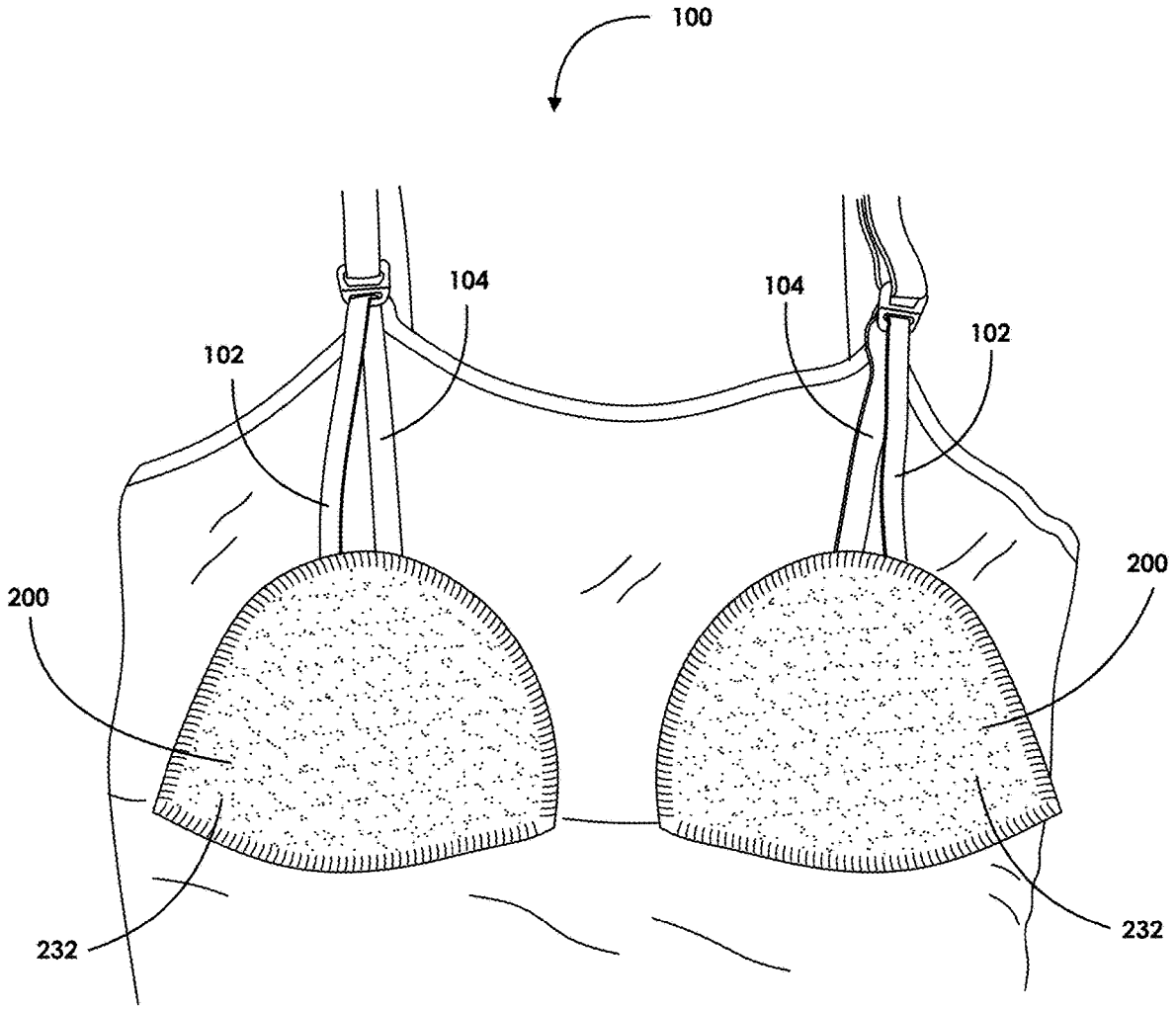
FIG. 2 illustrates a partial close-up rear view of the nursing garment and its removable pads of FIG. 1.
Figure 3:
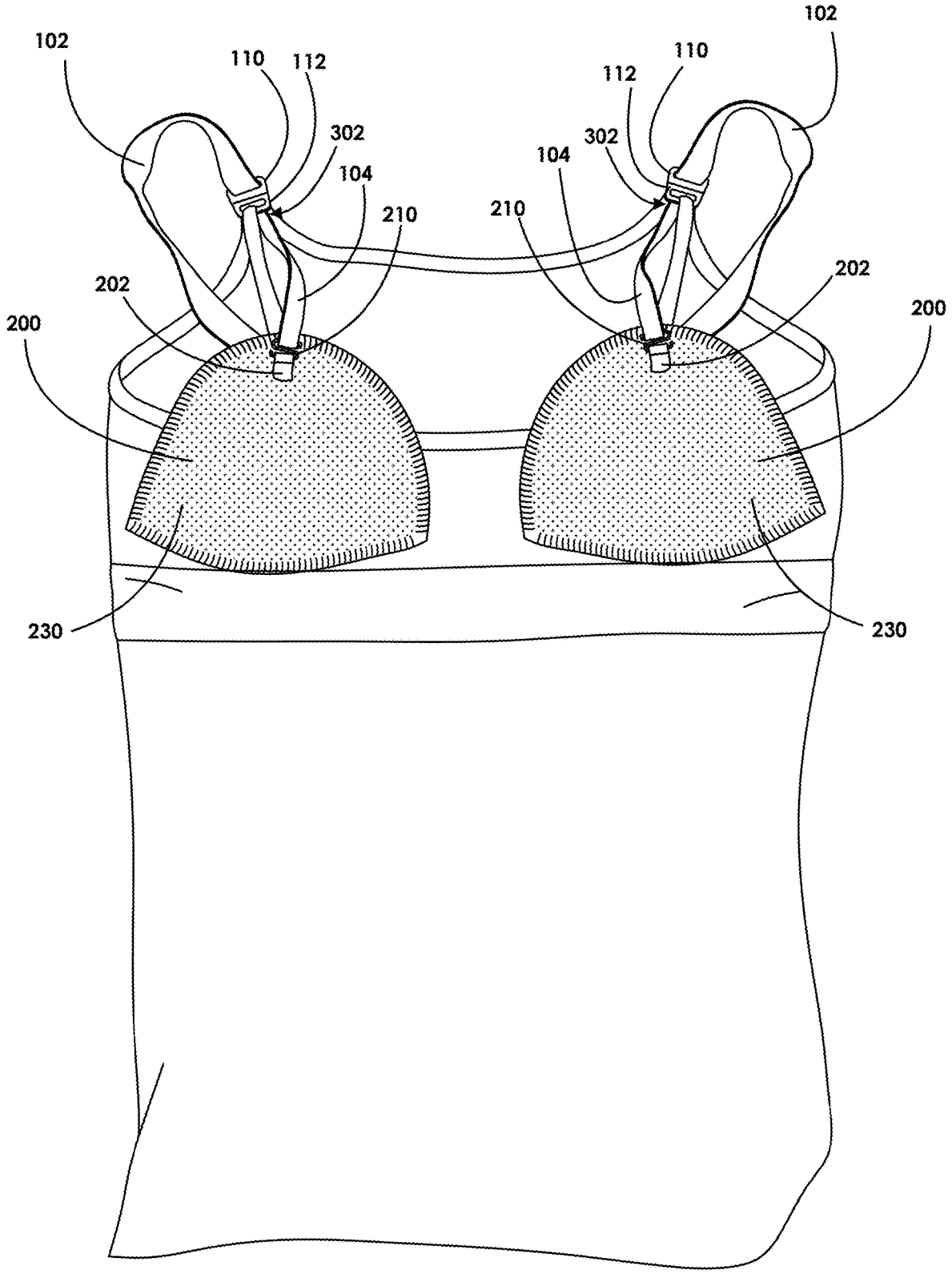
FIG. 3 illustrates another rear view of a nursing garment and a front view of its removable pads of FIG. 1.

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Referring to FIGS. 1-8B, the nursing garment 100 can generally include a woven, elastic, stretchable tank body having front and back layers 300 and a pair of removable breast pads 200. Here, body 300 can be made of about 89% polyester and 11% spandex. However, it is contemplated within the scope of the present disclosure described herein that the layers of body 300 may be made of any material, including but not limited to cotton, wool, leather, lycra, or the like. Garment 100 can further include a pair of straps 102 that have each of their ends secured, stitched, and affixed to body 300. Specifically, referring to FIG. 6A, one end of strap 102 is secured to the rear of layer of body 300 at region 306 and another end of strap 102 is secured to the front of layer of body 300 at region 304 of garment 100. In addition, it is contemplated within the scope of the present disclosure described herein that strap 102 may be elastic and adjustable to any length and may include multiple layers of adjustable straps or a single strap.

Figure 6A:
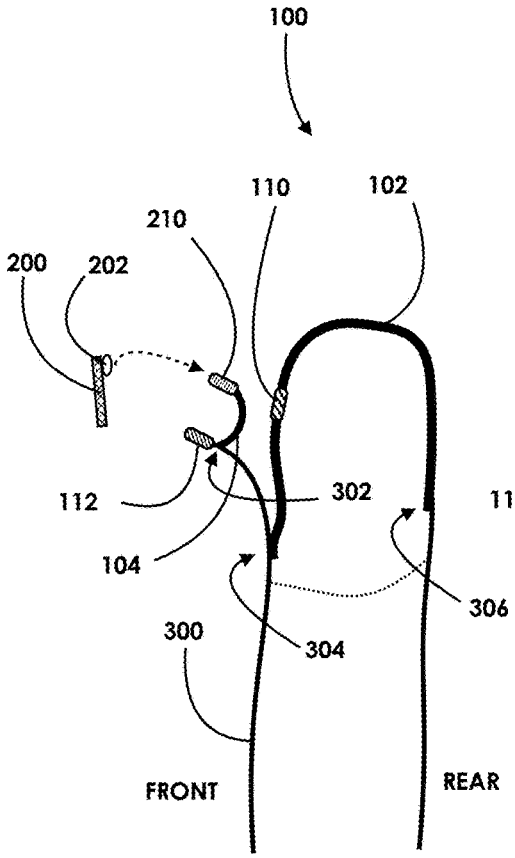
FIGS. 6A-6C illustrate simplified partial side views of the nursing garment of FIG. 1 and one non-limiting exemplary embodiment for a method of operation.

Still referring to FIG. 6A, garment 100 further includes a pair of straps 104 with one end secured, stitched, and affixed to the front layer of body 300 at region 302, and another end having a connector or removable securement member 210 for connecting or securing each strap 104 to each respective pad 200. In the current embodiment, the pair of straps 102 are of a fixed length depending on the specific size or bust size of garment 100. Here, the pair of straps 104 may range from about one (1) in. up to about six (6) in., preferably from about 3 and ⅝ in. to about 4 and ⅜ in. For example, a size small (S) may preferably include an about 3 and ⅝ in. strap, whereas a size large (L) may include an about 4 and ⅜ in. strap. Here, the size of the bust and/or chest will affect how much length is needed for each of strap strap 104 in order for each breast pad 200 to sit or be positioned at an adequate placement within the garment. Here, the disclosed strap length sizes and range are such that each nursing pad 200 would be able effectively and comfortably sit or be positioned over the nipple of the user and absorb leaking breast milk. Hence, through experimental testing, it was found that the disclosed ranges and sizes for the length of straps 104 is optimal to prevent each strap from being too short such that each pad 200 does not sit too high above the nipple, thereby missing the nipple and allowing for breast milk to leak more easily through the garment. In addition, the length of the disclosed sizes and ranges for straps 104 are not overly long, which could increase the amount of elastic strap material that can bunch up and visibly come out of the garment or cause a "bulky" look as the elastic strap can continuously fold upon itself. In addition, straps 104 may be made of any elastic or stretchable material. It contemplated within the scope of the present disclosure described herein that straps 104 may be of any length and may further be adjustable to any desired length.

Referring to FIGS. 4A-5B, each pad 200 includes a securement or receiving member 202 for securing each securement member 210 of strap 104 to pad 200. In particular, securement or receiving member 202 can be a band or strap that is folded over to define an open loop region 206 and further stitched (via a straight stitch) and affixed at regions 204A and 204B to a bottom layer 230 of pad 200. Here, opening 206 of member 202 is slightly large enough to allow a partial J-hook of securement member 210 to be slid therethrough. Accordingly, the size of the opening of region 206 allows for a slim fit of member 210 therein, wherein member 210 is securely held in place and not subject to slipping out of opening 206 while pad 200 is being maneuvered or worn by the user. Accordingly, member 210 is configured to be removed from opening 206 of member 202 via the user slightly tilting or angling member 210 and then actively pulling it out of opening 206.

Figure 4A:
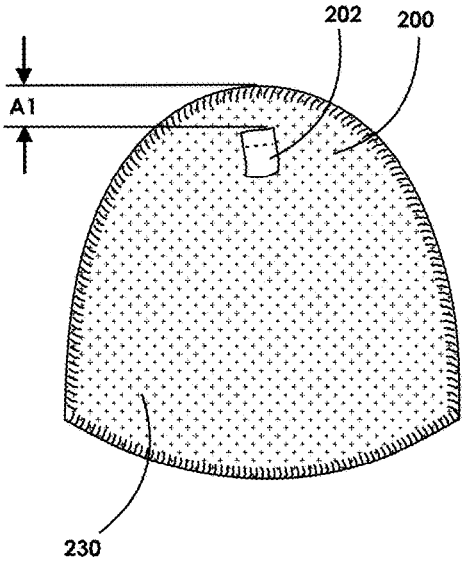
FIG. 4A illustrates a front view of the removable pad of the nursing garment of FIG. 1.

Referring to FIG. 4A, the top of receiving member 202 is also positioned at a distance A1 of about ½ in. below the uppermost top or apex region of pad 200. The position and configuration of receiving member 202 allow it to not only be hidden from view but further allow securement member 210 to be hidden from view (when pad 200 is viewed from the front), while still allowing pad 200 to be properly supported and balanced in a substantially upright configuration. In addition, the position of member 202 is such that it prevents the user form inadvertently "hooking" the stitching around pad 200 and breaking that stitching. Further, if the position of member 202 were lower than disclosed, then each pad 200 could sit higher on the chest and would not allow for as much range for how low the pad can sit on the breast. It is contemplated within the scope of the present disclosure described herein that securement member 210 may be any member for securing, locking, coupling, or attaching to opening 206 of member 202, or connecting to pad 200 generally. For example, securement members 210 or 202 can be any type of a clip, carabiner, ring, hook, snap, adhesive, hook and loop fastener (Velcro®), or pin, among others.

Figure 4B:
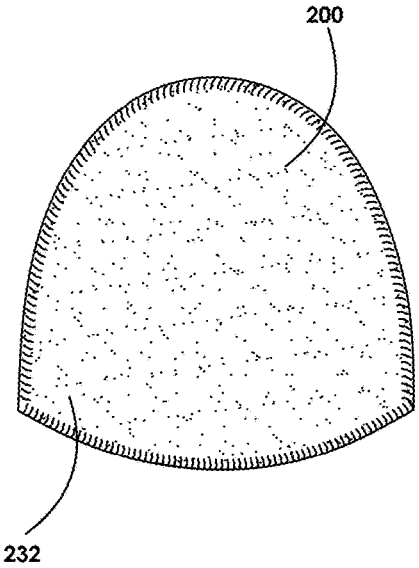
FIG. 4B illustrates a rear view of the removable pad of the nursing garment of FIG. 1.
Figure 4C:
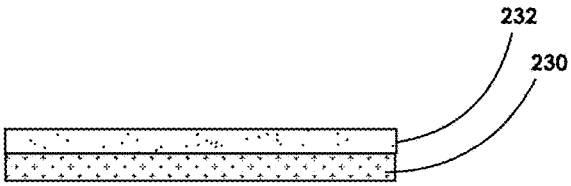
FIG. 4C illustrates a partial cross-sectional view of one or more layers of the removable pad of the nursing garment of FIG. 1.
Figure 4D:
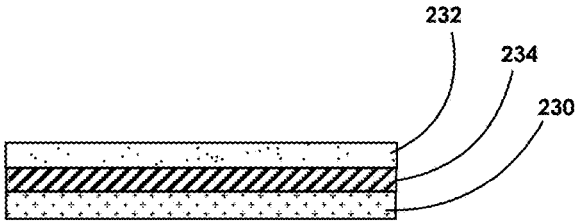
FIG. 4D illustrates a partial cross-sectional view for another embodiment of one or more layers of the removable pad of the nursing garment of FIG. 1.
Figure 5A:
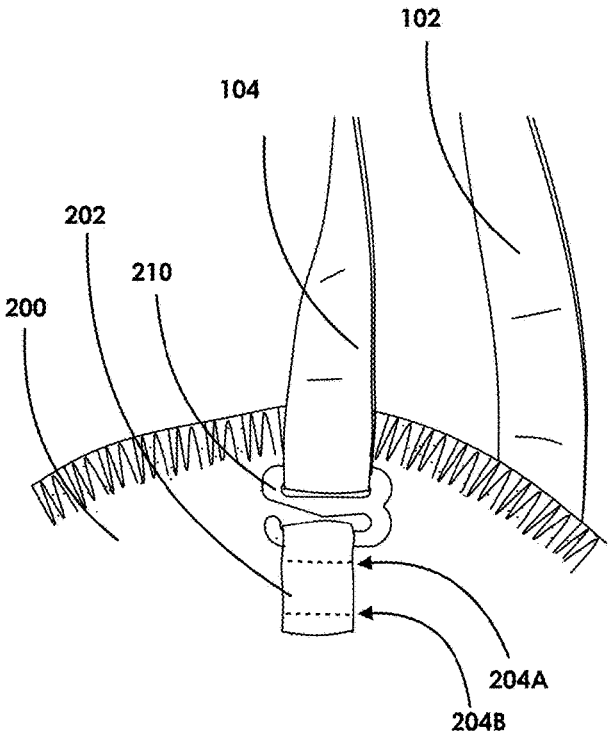
FIG. 5A illustrates a partial close-up front view of the removable pad of FIG. 1, further illustrating a receiver and securement member.
Figure 5B:
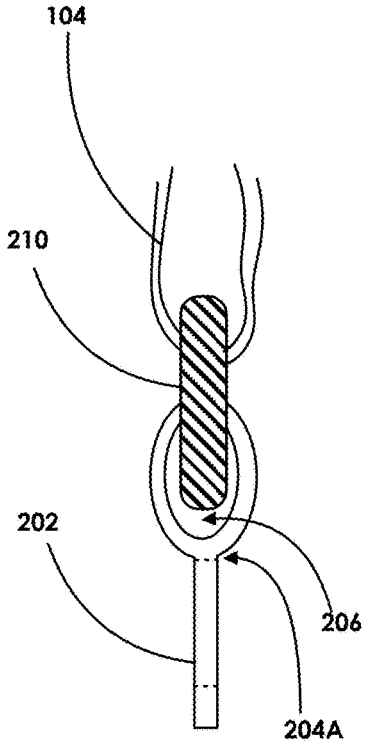
FIG. 5B illustrates a simplified side view of the receiver and securement member of FIG. 5A.

Referring to FIGS. 4A-4C, each pad 200 can include a top cover layer 232 and a bottom cover layer 230. Specifically, top layer 232 can be comprised of an absorbent and soft velour fabric type material having about a blend of about 67% bamboo viscose, about 28% organic cotton, and about 5% polyester. In particular, the soft surface texture of layer 232 that abuts the breast and nipple of the user allows pad 200 to be worn with all day comfort. In addition, layers 232 further provides superior liquid absorbing qualities. Bottom layer 230 can be comprised of an absorbent fabric type material having a dimple pattern or indentation type of pattern that can further absorb liquids and have leak-proof properties. In addition, layer 230 may also include a polyurethane laminate. In particular, layer 230 can be made of a blend of about 85% organic cotton and about 15% polyester. FIG. 4D illustrates another embodiment for pad 200, wherein it can also include a middle padding layer 234 disposed between the top layer 232 and bottom layer 230. In this embodiment, middle padding layer 234 can be any type of foam or cellulose type of padding that can further provide additional liquid absorbing qualities. Referring back to FIG. 4C, top layer 232 and bottom layer 230 can be further stitched together around their border with a serger seam. However, it is contemplated within the scope of the present disclosure described herein that any other type of securing means may be used, such as via a straight stitch, adhesives, or the like. In addition, it is contemplated within the scope of the present disclosure described herein that pads 200 can be disposable, reusable, and machine washable. In addition, each of pads 200 may come in varying sizes or configurations, depending on user bust size. Here, through experimental testing, the shape of pad 200 was found to be the most optimal relative to conventional or prior art pads. In particular, the shape of each pad 200 allows more "cupping" or "hugging" of each breast better than other shapes, such as a round shape pad, which further allowed for more absorption of liquid.

Figure 9A:
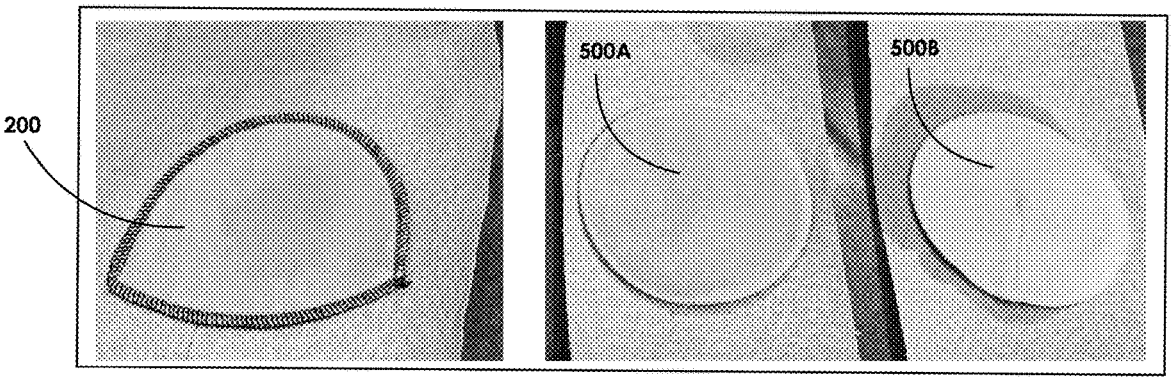
FIGS. 9A-9C illustrate top view photographs of the removable pad of the nursing garment of the disclosure described herein and top view photographs of conventional pads with respect to testing purposes.
Figure 9B:
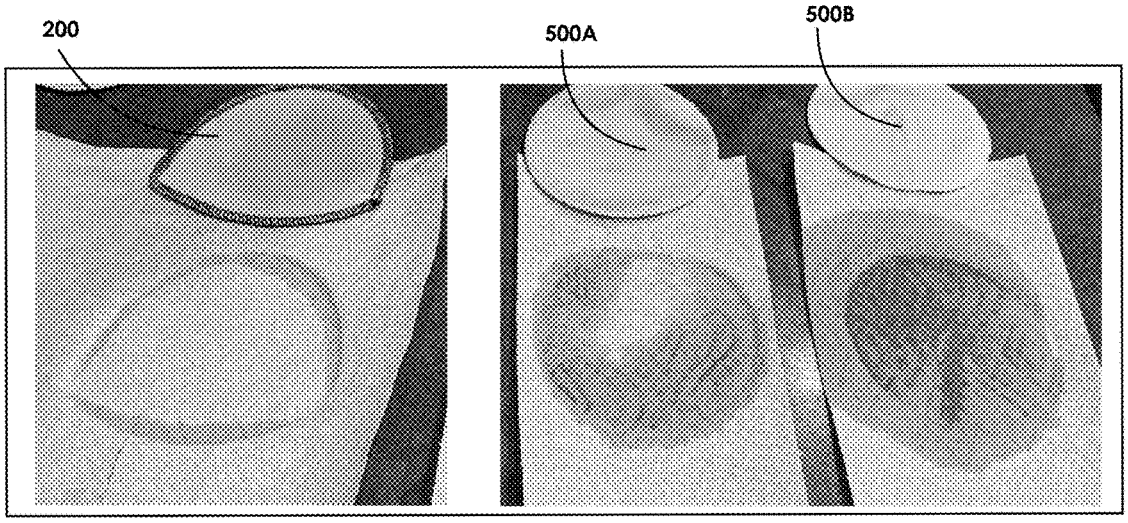
Figure 9C:
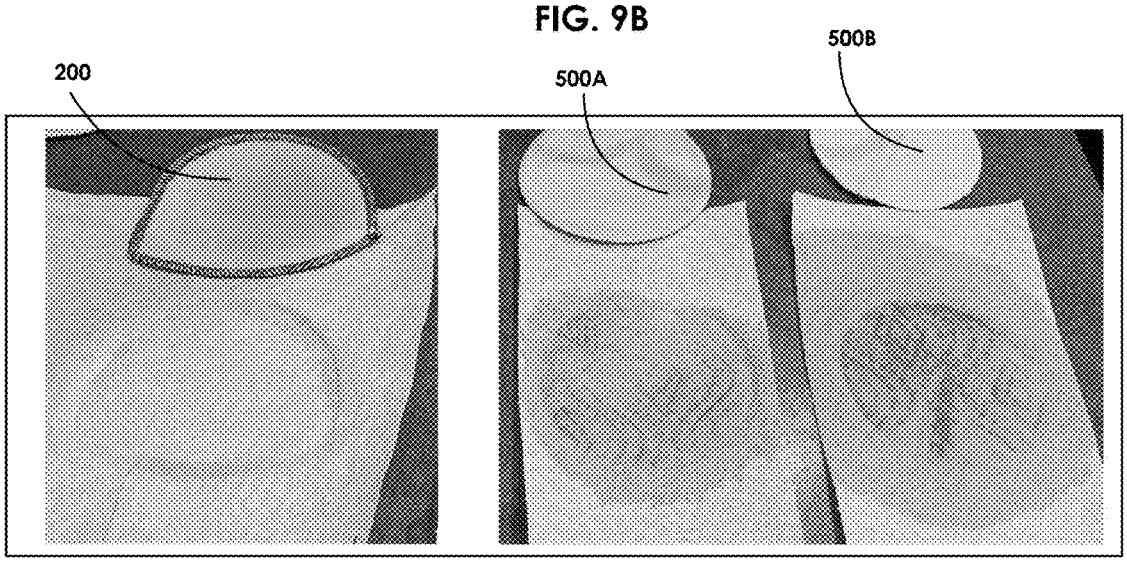

Still referring to the embodiment of FIGS. 4A-4C and FIGS. 9A-9C, the combination of layers 230 and 232 were found to be the most optimal for absorbing liquids relative to conventional or prior art breast pads 500A and 500B. Specifically, referring to FIGS. 9A-9C, pad 200 of the disclosure described herein was tested against conventional or prior art breast pads 500A and 500B with respect to absorption of the same amount of liquid water wherein each of the pads were placed over a sheet of paper towel. Referring to FIG. 9A, each of the pads had about one (1) oz. of water poured near their middle region (which would generally coincide with milk leaking from the nipple). FIG. 9B illustrate the results of the test after about a 10-minute waiting period and FIG. 9C illustrates the results after about a 40-minute waiting period, wherein each paper towel corresponding to each respective pad was observed. As shown in FIGS. 9B-9C, pad 200 of the disclosure described herein demonstrated the most optimal absorption of the liquid which showed the least amount of liquid transfer to its corresponding paper towel and further showing a relatively dry area underneath the pad, relative to the conventional or prior art pads 500A and 500B. In particular, pad 500B demonstrated the worst performance, whereby its corresponding paper towel was nearly entirely saturated with the liquid, demonstrating the least amount of absorption of liquid by pad 500B. Accordingly, the combination of the shape and layers 230 and 232 of pad 200 of the disclosure described herein was found to provide the most efficient and effective result of absorbing liquid with respect to leaking breast milk relative to conventional or prior art pads, garments, or solutions.

Figure 6B:
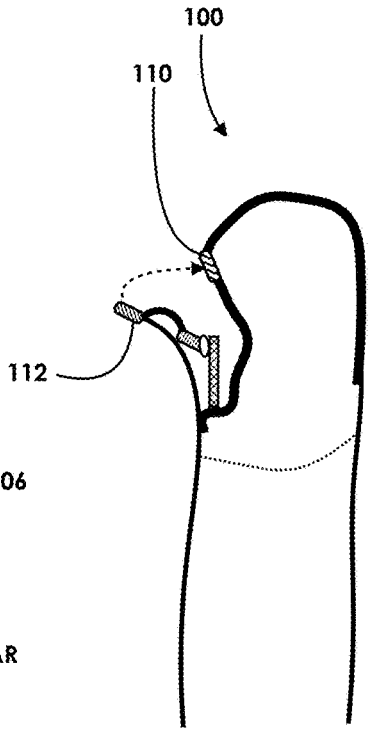
Figure 6C:
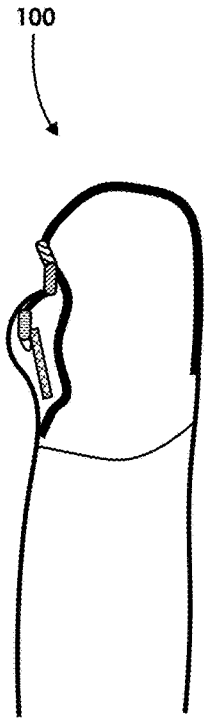
Figure 8A:
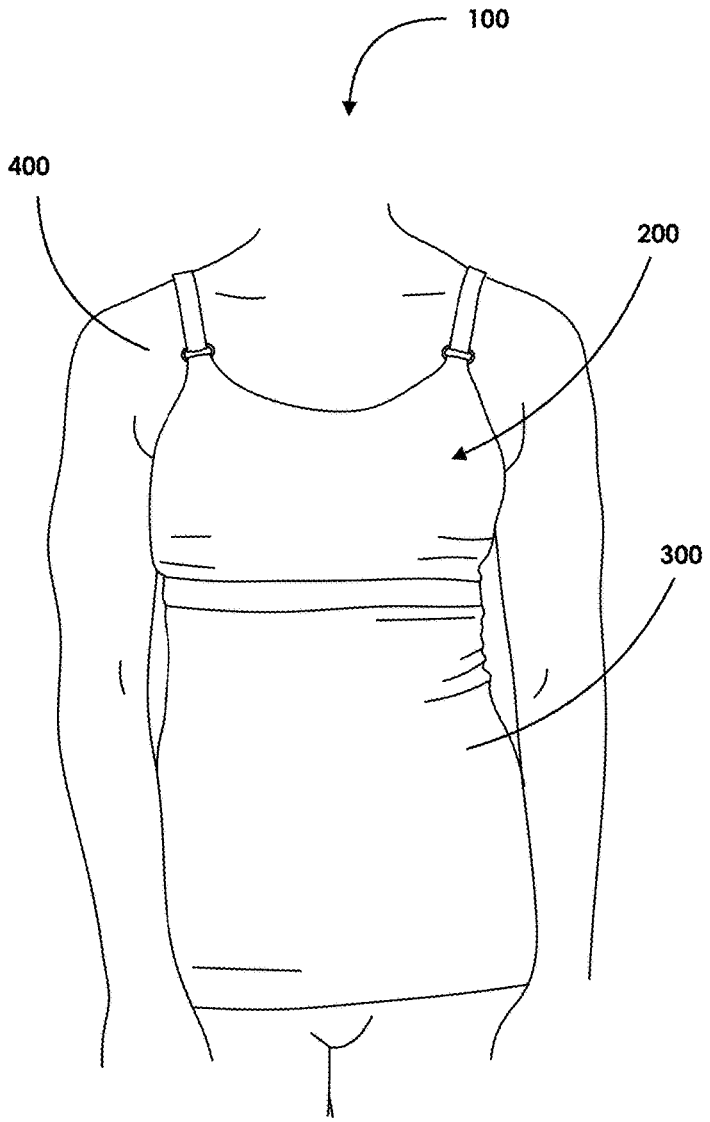
FIG. 8A illustrates a front view of the nursing garment of FIG. 1 as worn on a user.
Figure 8B:
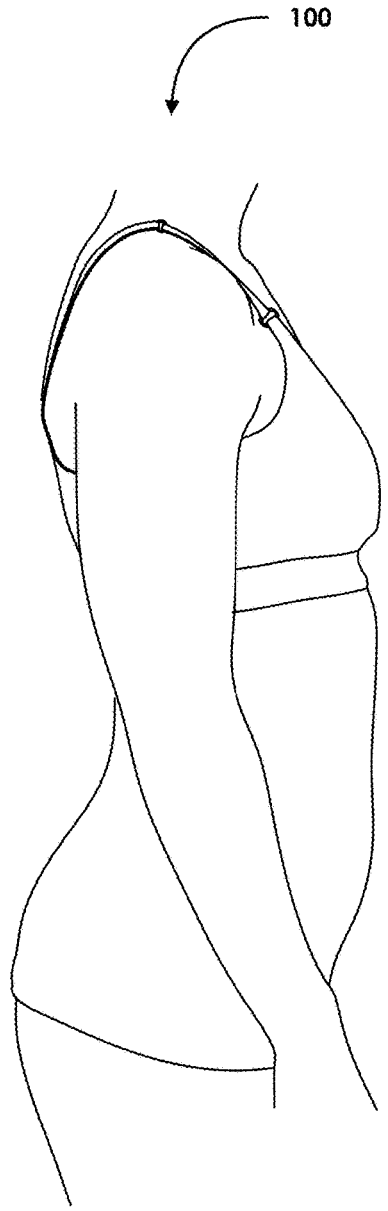
FIG. 8B illustrates a side view of the nursing garment of FIG. 8A as worn on the user.

FIGS. 6A-6C illustrate one method of operation of garment 100. Here, a user can initially disconnect member 112 from member 110 of strap 102. Next, the user can lower or drop region 302 of the garment and pull strap 104 and member 210 out of the garment. Next, the user can securely connect member 202 of each pad 200 to member 210. The user can then place and position pad 200 (connected to strap 104) within the bust or interior region of body 300, such that the top layer 232 of pad 200 is abutting the breast and the bottom layer 230 is abutting the interior surface region of the front layer of body 300. Once pad 200 is positioned therein, the user can then connect member 112 of strap 104 to member 110 of strap 102. As shown in FIGS. 8A-8B, once members 112 and 110 are reconnected, then strap 104 and pad 200 are hidden from view when the garment (as worn by the user) is viewed from the front or its sides.

Figure 7A:
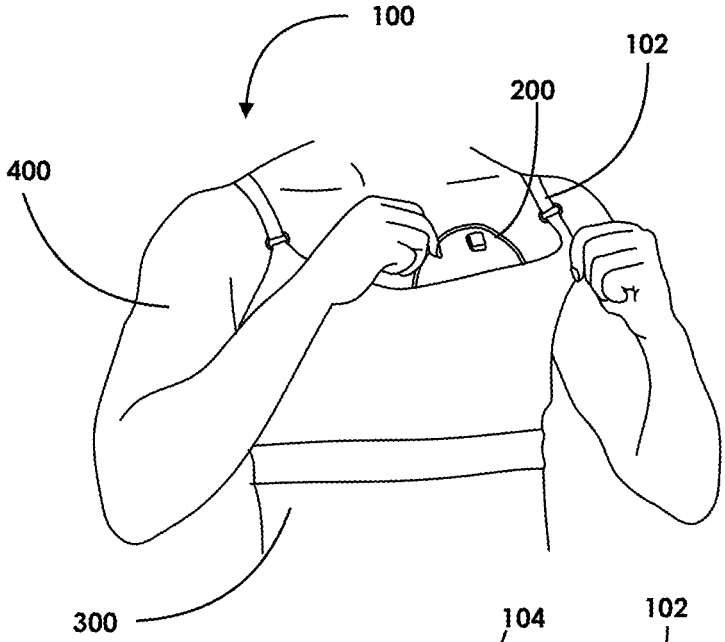
FIGS. 7A-7C illustrates partial perspective front views of the nursing garment of FIG. 1 and another non-limiting exemplary embodiment for a method of operation by a user.
Figure 7B:
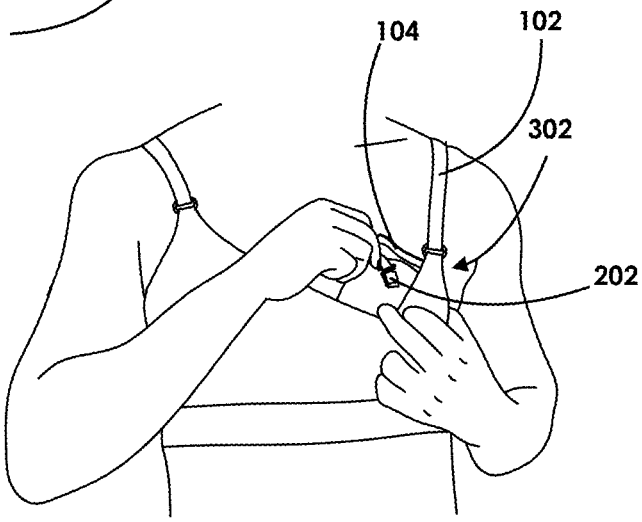
Figure 7C:
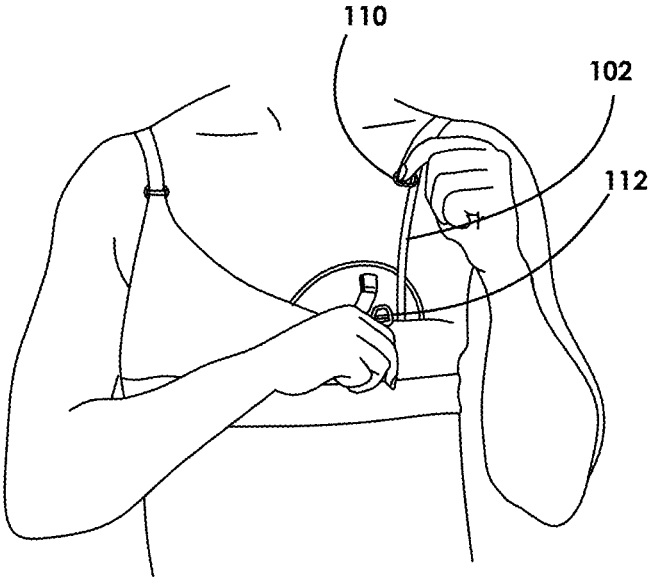

FIGS. 7A-7C illustrate another method of operation of garment 100. Here, the user can slightly pull away front chest region of garment 300 and initially place and position pad 200 within the interior bust region of body 300 in front of each breast. Once pad 200 is positioned in place, the user can then connect member 210 of strap 104 to member 202 of pad 200. Once members 210 and 202 are connected, the user can then connect member 112 and member 110. As shown in FIGS. 8A-8B, once members 112 and 110 are connected, then strap 104 and pad 200 are hidden from view when the garment (as worn by the user) is viewed from the front or its sides.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A nursing garment system, comprised of:

a body having a front and rear region, wherein the front region of the body comprises a first securement member;

a first strap having a first and second end affixed to the body;

a second securement member disposed between the first and second end of the first strap;

a second strap having a first end secured to the front region of the body;

a third securement member secured to a second end of the second strap;

a breast pad having a fourth securement member; and wherein the third securement member of the second strap is coupled to the fourth securement member of the breast pad, and the second securement member of the first strap is coupled to the first securement member of the body.

2. The nursing garment system of claim 1, wherein the fourth securement member of the breast pad is comprised of a looped opening.

3. The nursing garment system of claim 1, wherein the first, second, and third securement members are comprised of at least one of: a clip, carabiner, ring, hook, snap, adhesive, hook and loop fastener, or pin.

4. The nursing garment system of claim 1, wherein the breast pad is comprised of a liquid absorbing first layer and second layer.

5. The nursing garment system of claim 4, wherein the first layer is comprised of a velour fabric.

6. The nursing garment system of claim 4, wherein the first layer is comprised of about 67% bamboo viscose, about 28% cotton, and about 5% polyester.

7. The nursing garment of claim 4, wherein the second layer is comprised of about 85% cotton and about 15% polyester.

* * * * *